US006322330B1

(12) United States Patent
Thomas

(10) Patent No.: US 6,322,330 B1
(45) Date of Patent: Nov. 27, 2001

(54) COMPACT PERISTALTIC METERING PUMP

(76) Inventor: Carlisle A. Thomas, 13455 W. Augusta Dr., Augusta, MI (US) 49012

( * ) Notice: Subject to any disclaimer, the term of this patent is extended or adjusted under 35 U.S.C. 154(b) by 0 days.

(21) Appl. No.: 09/362,974

(22) Filed: Jul. 28, 1999

(51) Int. Cl.[7] ..... F04B 17/00
(52) U.S. Cl. ..... 417/360
(58) Field of Search ..... 417/360, 477.1, 417/477.11, 476

(56) References Cited

U.S. PATENT DOCUMENTS

| | | | | |
|---|---|---|---|---|
| 3,756,752 | * | 9/1973 | Stenner | 417/477.1 |
| 3,942,915 | | 3/1976 | Thomas | 417/360 |
| 4,210,138 | * | 7/1980 | Jess et al. | 604/67 |
| 4,229,299 | * | 10/1980 | Savitz et al. | 210/85 |
| 4,432,707 | * | 2/1984 | Anderson et al. | 417/477.7 |
| 4,544,336 | * | 10/1985 | Faeser et al. | 417/412 |
| 4,558,996 | * | 12/1985 | Becker | 417/374 |
| 4,692,147 | * | 9/1987 | Duggan | 604/93 |
| 4,813,855 | * | 3/1989 | Leveen et al. | 417/477.9 |
| 5,083,908 | * | 1/1992 | Gagnebin et al. | 417/477 |
| 5,181,842 | * | 1/1993 | Sunderland et al. | 417/474 |
| 5,433,588 | * | 7/1995 | Monk et al. | 417/477.2 |
| 5,518,378 | * | 5/1996 | Neftel et al. | 417/477.2 |
| 6,102,678 | * | 8/2000 | Peclat | 417/477.7 |

OTHER PUBLICATIONS

Photos 1–4 of Pump Assembly Marketed Pre Jul. 28, 1999.

* cited by examiner

*Primary Examiner*—Timothy S. Thorpe
*Assistant Examiner*—William H Rodriguez
(74) *Attorney, Agent, or Firm*—Flynn, Thiel, Boutell & Tanis, P.C.

(57) ABSTRACT

An improved, flexible tube, pump assembly comprising a housing having a cover, a motor unit and pump unit driven thereby. The motor unit and pump unit are fixed in said housing and said pump assembly comprises a minimal number of parts.

16 Claims, 9 Drawing Sheets

COMPACT PERISTALTIC METERING PUMP

FIELD OF THE INVENTION

This invention relates to a flexible tube pump, and more particularly to a compact, microdelivery, metering, peristaltic type pump.

BACKGROUND OF THE INVENTION

U.S. Pat. No. 3,942,915 discloses a commercially successful, peristaltic type, flexible tube, metering pump assembly, which was an earlier invention of the present Applicant.

A subsequent, commercially successful, peristaltic metering pump assembly of the present Applicant varies from the aforementioned patent disclosure, as follows. A motor unit was fixed to the inside face of a cover of a housing box. The housing box cover was fixed by screws to the open front of the housing box. The motor unit was alone in a housing box and the pump unit mounted on the outside of the housing box cover. A semi-circular shield of the pump unit had a solid rear wall spaced forward (outside) from and adjacent the housing box cover, circumferential end portions fixed by screws to the outside of the housing box cover, and a foot adjacent the central peripheral wall of the pump shield and resting on the outside face of the housing box cover. A second cover was fixed to the front of the pump shield, had a semi-circular shape and size conforming to the pump shield, and a lip which overlapped rearwardly the pump shield. The second cover provided a bearing for the outboard, front end of the rotor and notches for passage of pump tube ends. Washer-like discs snugly gripped the tube ends and abutted the notched portions of the lip of the second cover to prevent tube creep in use. A rectalinear third cover of transparent plastic, partially telescoped over the front portion of the motor housing box, enclosed the pump unit (including the second cover) and had holes through which the tube ends extend. An electric power cord extended from the housing box for connection to a suitable electric supply.

While both of these prior pump assemblies have been commercially successful, the present Applicant has continued development, resulting in an improved pump assembly embodying the present invention.

Accordingly the objects and purposes of this invention include provision of a flexible tube pump assembly providing improvements over prior pump assemblies of this kind including minimization of number of parts, simplified assembly and reduced manufacturing costs.

SUMMARY OF THE INVENTION

The objects and purposes of the invention are met by providing an improved, flexible tube, pump assembly comprising a housing having a cover, a motor unit and pump unit driven thereby. The motor unit and pump unit are fixed in said housing and said pump assembly comprises a minimal number of parts.

Other objects and purposes of this invention will be apparent to persons acquainted with apparatus of this general type upon reading the following specification and inspecting the accompanying drawings.

DETAILED DESCRIPTION

Figure 1:
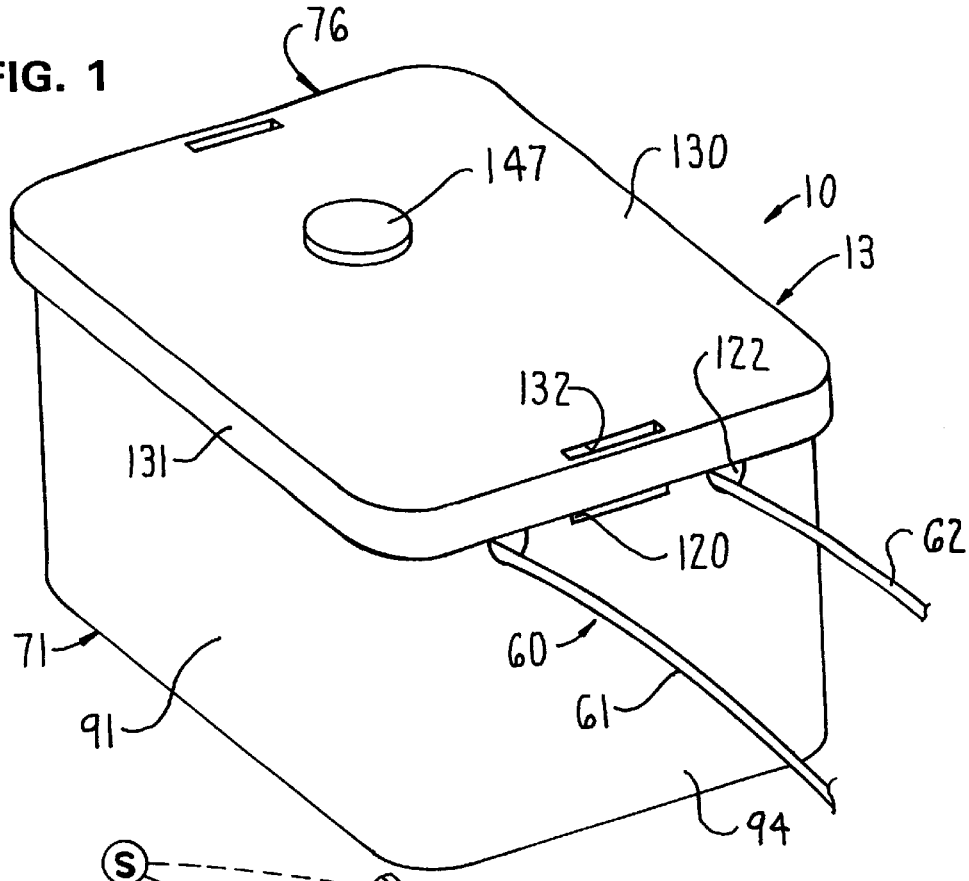
FIG. 1 is a pictorial view of a pump assembly embodying the invention, taken generally from the front thereof.

A pump assembly 10 (FIGS. 1 and 2), embodying the invention, comprises a housing 13, a motor unit 11 (FIGS. 3 and 4) and a pump unit 12. In the preferred embodiment shown, the motor unit comprises a conventional gear motor having a casing 14. The casing 14 includes a generally cylindrical motor casing portion 15, for enclosing conventional electric motor components (not shown), and a gear casing portion 16 which as shown in FIG. 3 extends upwardly beyond, and laterally (to the left in FIG. 3) overhangs the motor casing portion 15. The gear casing portion 16 encloses a conventional reduction gear train (not shown) positively driven by the motor components in casing portion 15 and further supports by suitable bearings, one of which is indicated at 17 (FIG. 3), a drive shaft 18. The drive shaft 18 extends forwardly (upwardly in FIG. 3) from the gear casing portion 16.

Figure 2:
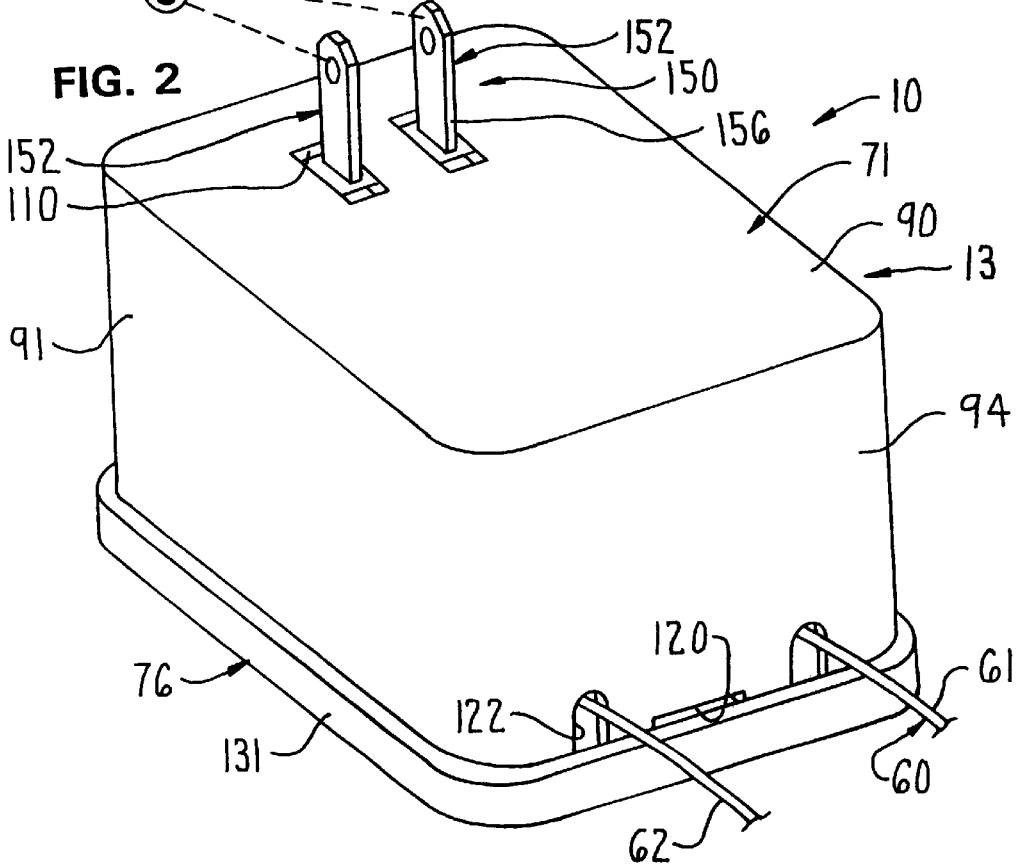
FIG. 2 is a pictorial view of the FIG. 1 pump assembly taken generally from the back thereof.
Figure 3:
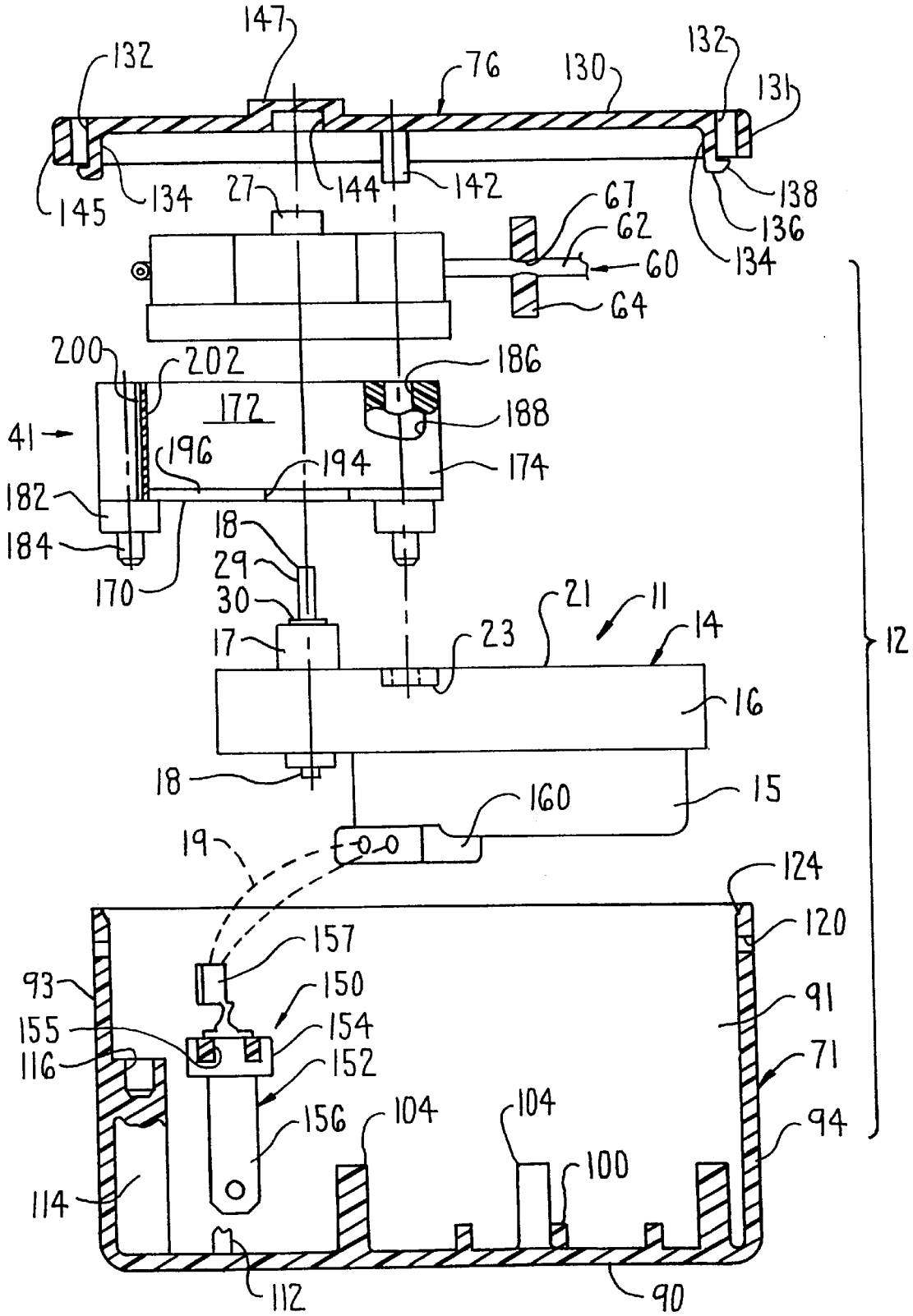
FIG. 3 is a partially broken, exploded side elevational view of the FIG. 1 pump assembly.

An insulated power cable schematically indicated at 19 (FIG. 3) extends from the motor casing portion 15 and contains electrical conductors, not shown, connectable to a suitable voltage supply S (FIG. 2). The supply S may be of any conventional nature. For example, the supply S may be a switchable AC supply wherein the motor unit 11 may be a fixed rpm AC synchronous motor. Alternatively, the supply S may be a variable voltage DC supply wherein the motor unit 11 may be a variable speed DC motor. It is contemplated that other variations in motor type and electrical supply type may be utilized.

In the preferred embodiment shown, the front wall 21 of the gear casing portion 16 is a substantially plate-like member having a pair of mounting elements, or ear-like projections, 23 (FIGS. 3 and 17) extending laterally outboard of the gear casing portion 16 and having holes 24 therethrough.

The motor unit 11 may, for example, be a slow speed gear motor of the type manufactured by Autotrol Corporation of Crystal Lake, Ill.

The pump unit 12 comprises a generally disk-like rotor 26 (FIGS. 3 and 12) including a disk 25 and a substantially cylindrical boss 27, integral with and extending forwardly from the disk 25. A central opening 28 extends through the rotor 26 for snugly receiving the shaft 18 of the motor unit 11 therein. In the embodiment shown, the shaft 18 is provided with a flat 29 and the central opening 28 is of corresponding cross-section to establish a positive drive connection between the shaft and rotor. The flat 29 defines a step 30 on the shaft 18 which abuts the rear face of the rotor disk 25 to positively axially locate the rotor with respect to the shaft, and here in spaced relation from the gear casing portion 16. The shaft 18 and rotor 26 are preferably snugly interfitted to prevent axial slippage therebetween The forward end of the central opening 28, at the forward end of the boss 27, is radially enlarged at 31.

Figure 12:
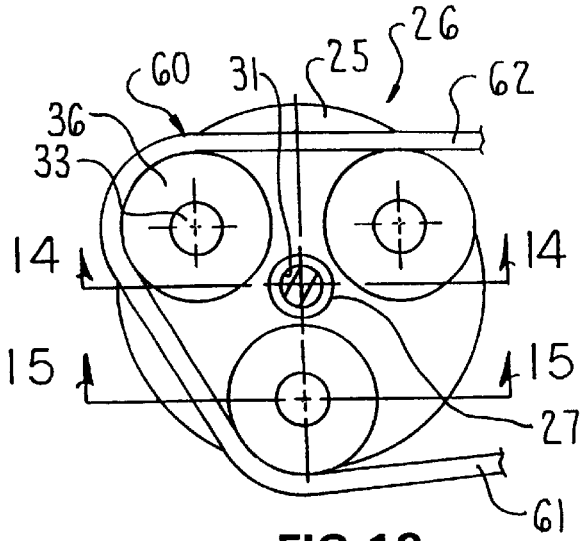
FIG. 12 is a front view of the FIG. 3 rotor.
Figure 14:
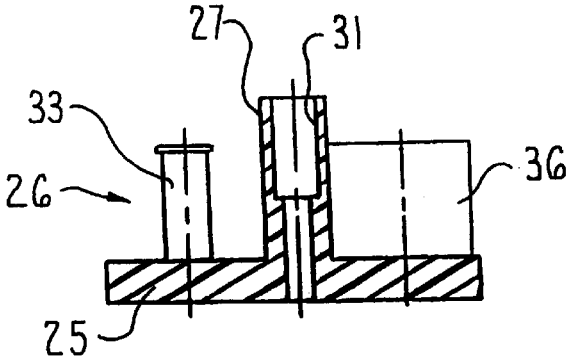
FIG. 14 is a sectional view substantially taken on the line 14—14 of FIG. 12.

The rotor 26 further includes a plurality, here three, of identical, forwardly extending, integral spindles 33 (FIGS. 12 and 14). The spindles 33 are evenly circumferentially spaced on the forward face of the disk 25 and are radially spaced somewhat inboard of the periphery thereof. The spindles 33 preferably are each cylindrical, except for an enlarged head 34 (FIG. 15) at the forward end thereof.

Figure 15:
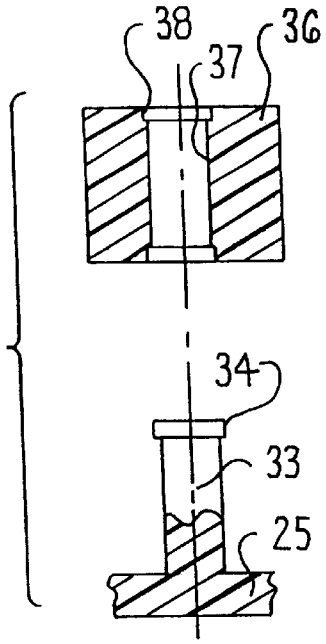
FIG. 15 is an enlarged, fragmentary, exploded, cross sectional view substantially taken on the line 15—15 of FIG. 12.
Figure 13:
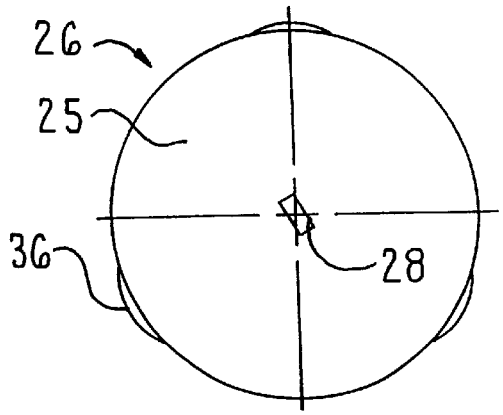
FIG. 13 is a rear view of the FIG. 12 rotor.
Figure 16:
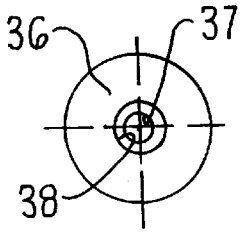
FIG. 16 is an enlarged front view of one of the FIG. 12 roller and spindle units.

Impeller members here comprise substantially cylindrical, hollow rollers 36 (FIGS. 15 and 16). Each roller 36 includes a cylindrical central opening 37, here recessed at the ends thereof, as indicated at 38. The rollers substantially correspond in length to the spindles 33. Each roller is snap fitted over the head 34 of its corresponding spindle 33 to assume the assembled position shown in FIGS. 12 and 14, wherein each roller 36 rotatably bears on the central portion of its spindle 33 in a radially snug but freely rotatable manner. Engagement between the head 34 and the adjacent recess 38 maintains the roller on the spindle in normal use and, with suitable end clearance, maintains the rear face of the roller 36 close adjacent the disk 25. The diameter of the rollers 36 is such as to enable same to slightly overhang the edge of the disk 25.

Due to the relatively light axial loading on the rollers 36 and due to the low friction qualities of the material utilized for the rollers 36 and disk 25, the rollers 36 have been found to rotate freely despite the absence of an intervening thrust bearing between same and the disk 25 and despite the relatively large area of potential rotational contact therebetween.

The pump unit 12 further includes a shield 41 (FIGS. 3 and 8), having a semicircular peripheral wall 49.

The rotor 26, rollers 36, and shield 41 are preferably molded from suitable synthetic resin materials, such as nylon and/or delrin, and preferably require no machining. For example, a delrin shield and nylon rotor may be used with rollers of nylon or delrin, delrin-nylon interfaces providing low friction and long wear.

A flexible, elongate tube 60 (FIG. 19) extends along the interior face of the shield peripheral wall 49 and has ends 61 and 62 extending along and past the end portions 43 and 44. The end 61 is connectible to a source F of fluid to be pumped and the end 62 is connectible to a desired fluid consuming device generally indicated in U. The tube 60 has a flexible wall and is elastically compressible to close the central passage therethrough where, as at 63 (FIG. 19), the tube is contacted by and sandwiched between a roller 36 and the shield peripheral wall 49. The fluid may be a gas or liquid.

Figure 5:
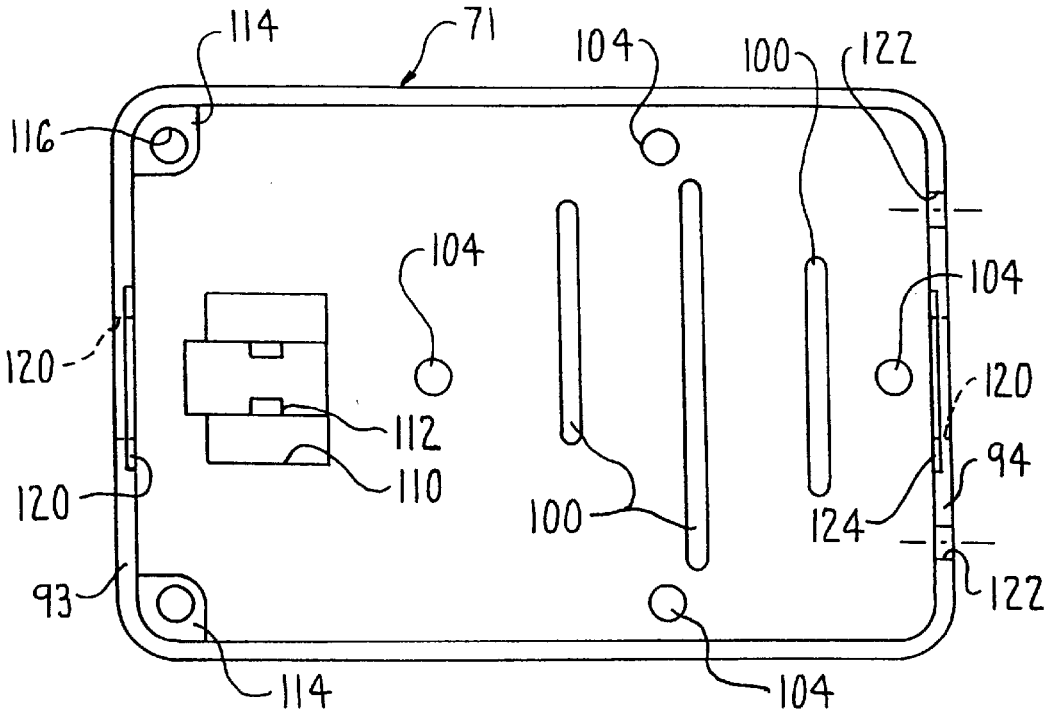
FIG. 5 is a front elevational view of the housing cup of FIG. 1.
Figure 19:
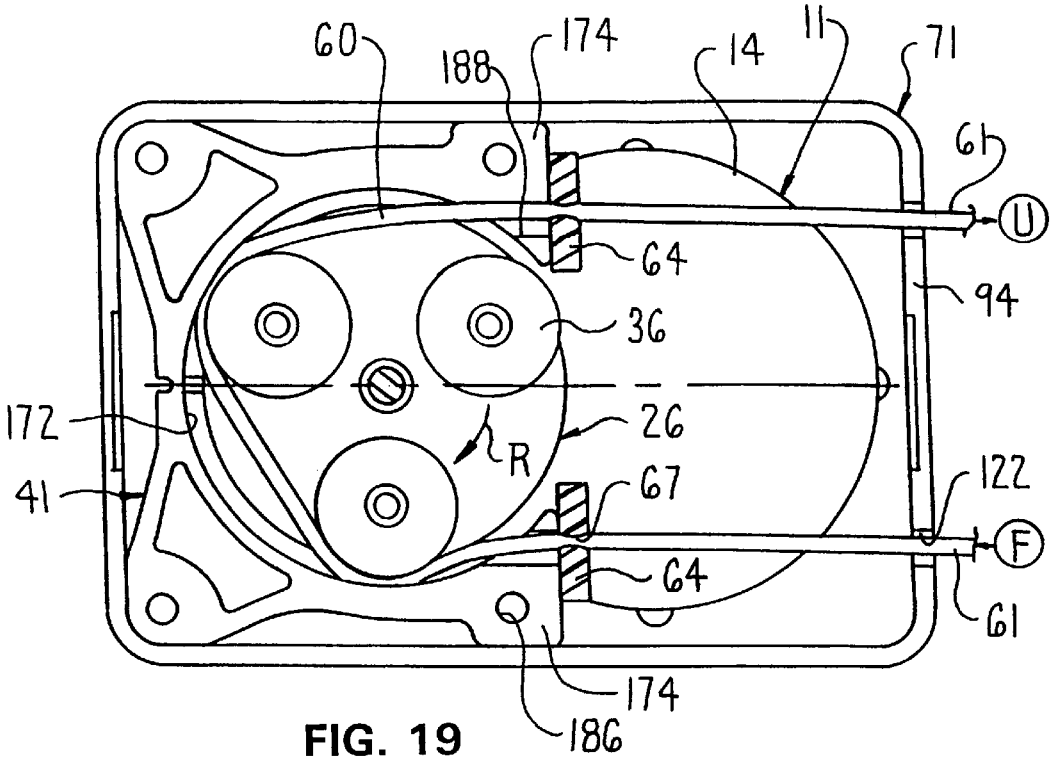
FIG. 19 is a view similar to FIG. 17 but with the pump unit installed.

The rotor 26, as seen from the front, in FIG. 19, is here arranged for clockwise rotation as indicated by the arrow R. The orbiting rollers 36, due to their compressive contact with the tube 60, tend to pull such tube in a clockwise direction therewith. Thus, in operation, the tube tends to creep along the surface of the shield, away from the fluid source F. To counteract this, the tube inlet end 61 (FIG. 5) is led through an undersized hole 67 in a retainer element 64. The hole 67 is sized to allow the tube 60 to be inserted thereinto and forcibly pulled axially therethrough, but to sufficient frictionally engage the outside of the tube 60 as to prevent unintended axial movement of the tube by the orbiting rollers 36. The undersize nature of the hole 67 does not materially constrict the passage within the tube.

The housing 13 (FIGS. 1, 3 and 4) comprises substantially rectilinear cup 71 and a cover 76.

To the extent above described, the pump assembly 10 corresponds generally to Applicant's pump assembly disclosed in his earlier U.S. Pat. No. 3,942,915.

Turning now to aspects of the pump assembly 10 more specifically involving the present invention, attention is directed to the following.

As to the housing 13, the cup 71 (FIGS. 3 and 5) comprises a back wall 90 from the perimeter of which forwardly extend sidewalls 91 and top and bottom end walls 93 and 94 joined to define a substantially rectangular box open to the front (upward in FIG. 3). The interior face of the back wall 90 fixedly carries forwardly projecting, sidewardly extending, elongate, substantially parallel, motor locator ribs 100 located in the half of the cup closest to the bottom end wall 94. Plural (here four) motor locator pins protrude fixedly forwardly from the back wall 90. The pins 104 extend forward beyond the ribs 100, and are offset away from the top end wall 3 and toward the bottom end wall 4. The pins 104 substantially bound the zone occupied by the ribs 100 and define corners of a square zone rotated 90° with respect to the substantially rectangular back wall 90. Restated, the pins 104 (FIG. 17) are evenly circumferentially distributed, i.e. are here separated by approximately 90° arcs. In the preferred embodiment shown in FIG. 5, two pins 104 are spaced along the longitudinal centerline of the back wall 90 on opposite ends of the array of ribs 101, one such pin 104 being disposed between the adjacent bottom end wall 93 and the nearest rib 100. The remaining two pins 104 are spaced across the width of the back wall 90, lie adjacent respective side walls 91 and flank the array of ribs 100.

Substantially rectangular holes 110 (FIG. 5) pierce the back wall 90, are spaced on opposite sides of the longitudinal centerline of the back wall 90, extend lengthwise in parallel with such longitudinal axis, lie adjacent the top end wall 93, and are spaced from the nearest pin 104. Slim rectangular cross section posts 112 extend fixedly forwardly from the back wall 90 at the central portion of the inboard edge of respective ones of the holes 110.

Corner bosses 114 at the joinder of the top end wall 93 to the sidewalls 91 (FIG. 5) extend fixedly forward from the back wall 90 a bit more than half way to the forward edge of the top end walls and sidewalls 93 and 91. Each corner boss 114 has a forward opening blind bore 116.

Slim, generally rectangular slots 120 (FIGS. 3 and 4) pierce the top and bottom end walls 93 and 94 adjacent the front edges thereof and are preferably centered widthwise on the end walls 93 and 94.

Notches 122 (FIGS. 4 and 5) in the front edge of the bottom end wall 94 flank the adjacent rectangular slot 120 and are each preferably approximately equidistant between such slot 120 and the adjacent one of the sidewalls 91.

The interior front corner edges of the top and bottom end walls 93 and 94 (FIG. 3) are beveled at 124, the bevels 124 being centered on and extending at least the width of the slots 120.

Figure 6:
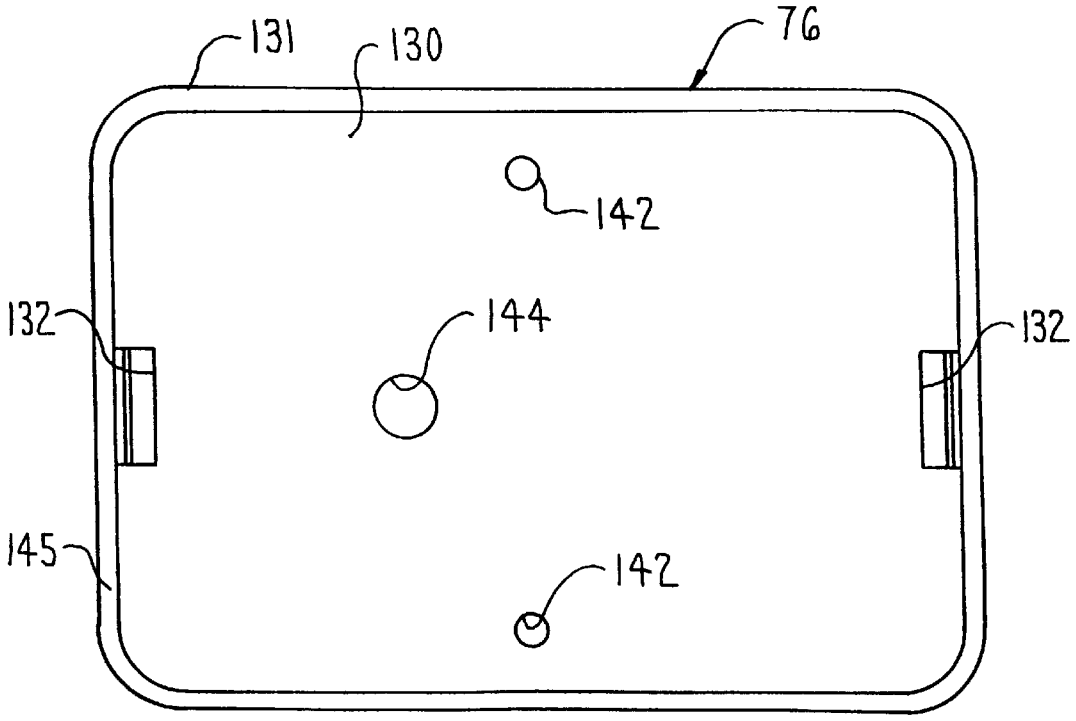
FIG. 6 is a rear view of the FIG. 1 cover.
Figure 7:
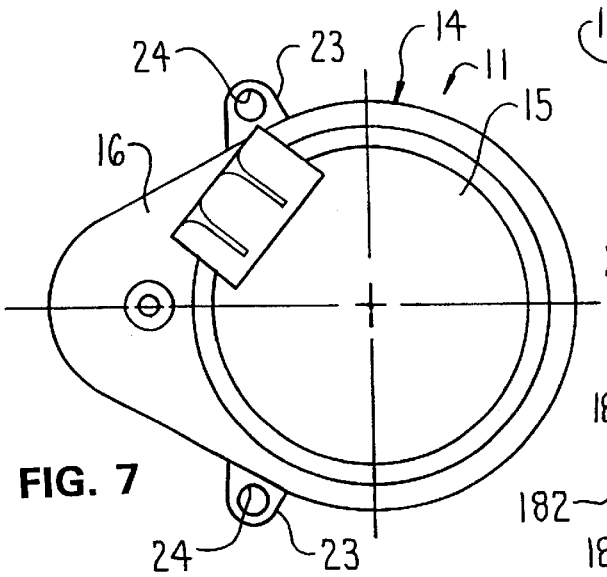
FIG. 7 is a rear view of the motor unit of FIG. 3.
Figure 11:
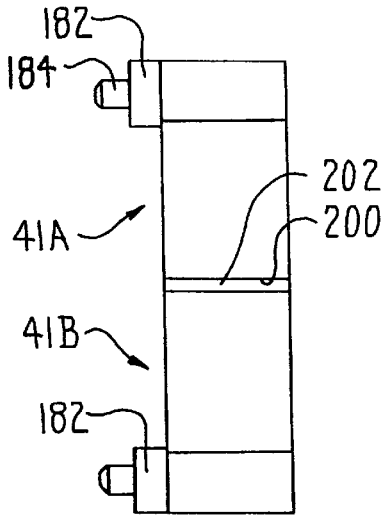
FIG. 11 is a rear view of the FIG. 8 shield.

The cover 76 (FIGS. 3, 4 and 6) comprises a front wall 130 having a rearward protruding peripheral lip 131. The interior surface of the front wall 130 is adapted to abut the front edges of the side, top and bottom walls 91, 93 and 94, respectively, of the cup 71 to close the open front thereof. The interior faces of the lip 131 being sized to smoothly but snugly telescope over the outer surfaces of the side, top and bottom walls 91, 93 and 94, respectively, of the cup 71.

Rectangular holes 132 pierce the front wall 130, extend transversely of and are substantially centered on the central length axis of the cover 76, and lie immediately inboard of the peripheral lip 131. Resiliently bendable, generally plate-like, snap fastener legs 134 fixedly protrude rearwardly from the interior face of the front wall 130 at the inboard edge of respective ones of the holes 132, in corresponding spaced relation inboard of the peripheral lip 131. Each snap fastener leg 134 fixedly terminates in a foot 136 spaced somewhat rearward beyond the peripheral lip 131. The foot 136 projects laterally outboard sufficient to partially overlap the corresponding hole 132, the peripheral lip 131 preferably being spaced slightly outboard of the free end of each foot 136. The rear, outboard edge of each foot 136 is preferably beveled at 138. Each foot 136 is located to engage in corresponding hole 120 of the cup 71 to releasably snap fix the cover 76 snugly on the open front of the cup 71.

Shield locator pins 142 protrude fixedly rearward from the cover front wall 130, are approximately centered lengthwise of the cover, are spaced slightly inboard transversely of the peripheral lip 131, and are spaced substantially and transversely symmetrically from each other and with respect to the cover longitudinal centerline.

A rear opening substantially circularly cylindrical, rotor bearing recess 144 in the rear (interior) face of the front wall 130 is located on the longitudinal centerline of the cover 76, in spaced relation between the common plane of the shield locator pins 142 and the top (left in FIG. 6) portion 145 of the peripheral lip 131. A bulge 147 protrudes forward from the front wall 130 and closes the front end of the recess 144.

The cup 71 and cover 76 preferably each comprise a one-piece member molded of a suitable, substantially rigid, plastics material.

While the apparatus may be otherwise powered if desired, in one embodiment constructed according to the invention and here disclosed, the pump assembly 10 used an external electrical source and was adapted to plug into a conventional electric socket, here for example a conventional 115 volt AC duplex socket, not shown. To this end, the pump assembly 10 includes a conventional electric plug unit 150 (FIGS. 3 and 4) comprising a laterally spaced, parallel pair of substantially rigid, electrically conductive, spade elements 152 held in relative fixed relation at their midportions by end portions of an electrically insulative carrier 154. The carrier 154 is preferably of a rigid, molded plastics material molded around the spade elements 152 in a conventional manner. The carrier 154 has a central opening 155 having a length dimension extending between the spade elements 152 and a narrower, width dimension along the longitudinal centerline of the cup 71. The spade of the cup back wall 90 elements 152 each include a lug 156 extending rearward (downward in FIG. 3) from the carrier 154 and sized and shaped for insertion and electrical connection in a conventional 110 volt AC wall plug. The opposite, forward end of each spade element 152 defines a terminal 157 fixedly electrically engagable with a corresponding electrical conductor of the power cable 19. In the embodiment shown, the terminal 157 is generally U-shaped and may be crimped, or compressed, to fixedly clamp the end portion of an electrical conductor therein. The rectangular holes 110 in the back wall 90 of the cup 71 are spaced and sized to receive the lugs 156 therethrough. The carrier central opening 155 and sized to snugly but slidably receive the posts 112.

The motor unit 11 (FIG. 3) includes, on the back of the motor casing portion 15, a terminal block 160 to which the other end of the conductors of the cable 19 are conventionally fixedly electrically connected. In the embodiment shown, the motor shaft 18 has a diametrally opposed pair of flats 29 for more positive driving of the rotor 26.

Figure 10:
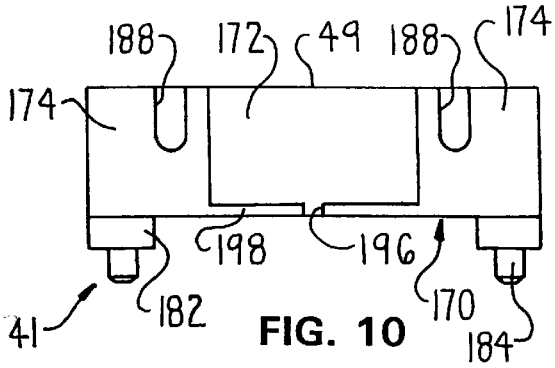
FIG. 10 is a front view of the FIG. 8 shield.

Turning now to the shield 41 (FIGS. 8, 8A and 9–11), a substantially planar back wall 170 extends across the back (bottom end in FIGS. 9 and 10) of the peripheral wall 49. The peripheral wall 49 comprises a smooth, cylindrical, semi-circular inner periphery 172. The peripheral wall 49 has pairs of bosses 174 and 176 extending substantially radially outward thereon. As seen in plan (FIG. 8) the bosses 174 are located at the free ends of semi-circular peripheral wall 49 (to the right in FIG. 8) and the bosses 176 are circumferentially spaced from each other and from the bosses 174 at intermediate points on the semi-circular peripheral wall 49, such that the bosses 174 and 176 define respective corners of a rectangle. The intermediate bosses 176 are substantially triangular in plan. The bosses 174 and 176 preferably have rounded corner edges. To reduce the amount of material used to form the shield 41, forward facing pockets 178 (FIG. 8) are formed in the radially intermediate portions of the bosses 176.

Figure 8A:
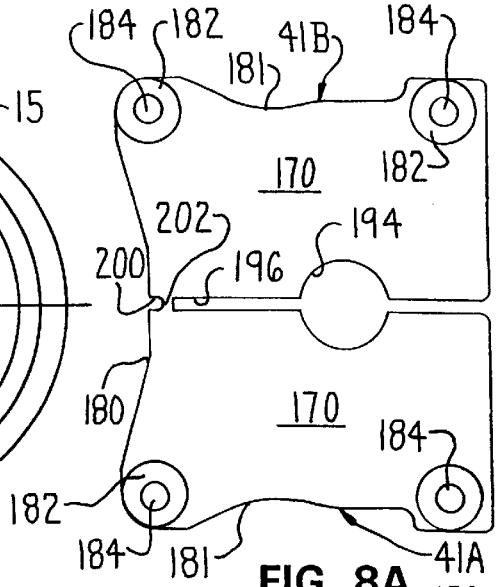
FIG. 8A is a bottom view of the FIG. 8 shield.
Figure 8:
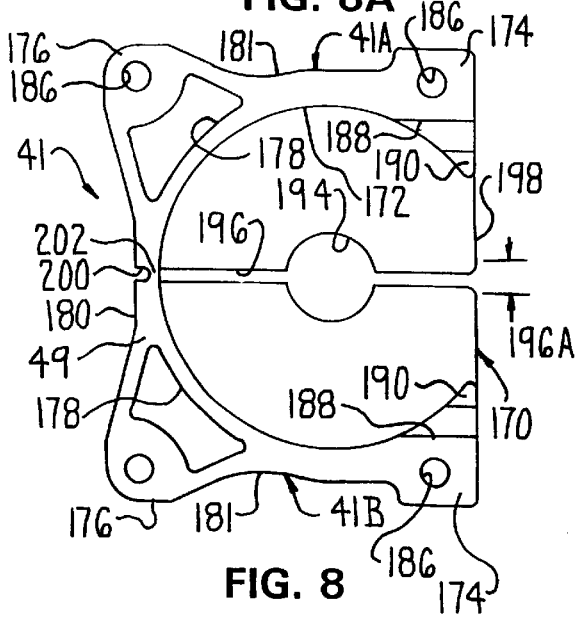
FIG. 8 is a front view of the shield of FIG. 3.
Figure 9:
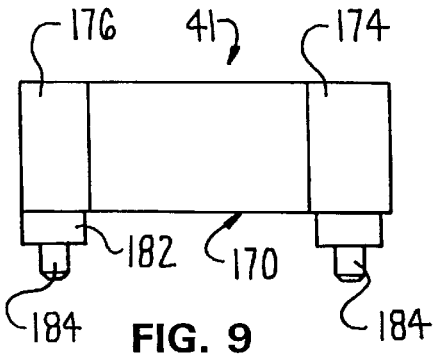
FIG. 9 is a side view of the FIG. 8 shield.

As seen at 180 and 181 in FIG. 8, the outer periphery of the peripheral wall 49 is indented between the bosses 176 and between each boss 176 and the adjacent boss 174, respectively.

Preferably circularly cylindrical stub columns 182 project rearward (downward in FIGS. 9 and 10) beyond the back wall 170 from the radially outboard portions of the bosses 174 and 176 (FIGS. 8A and 9–11). Preferably circularly cylindrical pegs 184 project rearwardly, preferably coaxially, from the stub columns 182 and are preferably chamfered at their rearward ends (bottom ends in FIGS. 9–11).

Blind bores 186 face forward (upward in FIGS. 9 and 10) in the radially outer portions of the bosses 174 and 176 and are preferably coaxial with the pegs 184.

Preferably parallel, round bottom grooves 188 (FIGS. 8 and 10) extend substantially in chordal relation to the semi-circular inner periphery 172, through the tapered end portions of the semi-circular peripheral wall 49, and are spaced inboard of the blind bores 186 in the bosses 174. The grooves 188 bottom approximately at the mid height of the inner periphery 172.

The back wall 170 has a central opening 194 (FIG. 8) coaxial with the inner periphery 172. The back wall 170 and central opening 194 are bifurcated by a central slot 196 to in effect divide the shield 41 into bilaterally symmetric halves. The slot 196 extends from the free edge 198 of the back wall 170 to the center of the inner periphery 172. A groove 200 is centrally formed in the outer face of the indented portion 180 of the shield peripheral wall 49, faces away from the inner periphery 172, and is coplanar with the slot 196. The slot 196 and groove 200 leave the two halves of the shield 41 joined by a slim, central, integral hinge portion 202 (FIG. 8) of the peripheral wall 49. The shield 41 is preferably a molded, unitary substantially rigid plastic element of sufficient resilience to enable the slim central portion 202 to act as an integral hinge and thereby permit limited pivoting of the two halves 41A and 41B of the shield 41 toward and away from each other.

The pump assembly 10 may be assembled as follows.

The conductors of the electric power cable 19 are fixed, in electrically conducting relation, to the respective terminals 157 (FIGS. 3 and 4) of the electric plug unit 150 by any convenient means, as by crimping and/or soldering. The lugs 156 of the electric plug unit 150 are then inserted rearward through the rectangular holes 110 in the cup back wall 90 until the carrier 154 rests against the inner surface of the back wall 90, with the posts 112 snugly received in the central opening 155 of the carrier 154 to thereby positively locate the electric plug unit 150 on the cup back wall 90. The electric plug unit 150 is fixed, preferably permanently, to the cup back wall 90 by any convenient means, such as adhesive bonding of the carrier 154 to the cup back wall 90, for example by an epoxy resin adhesive.

Figure 17:
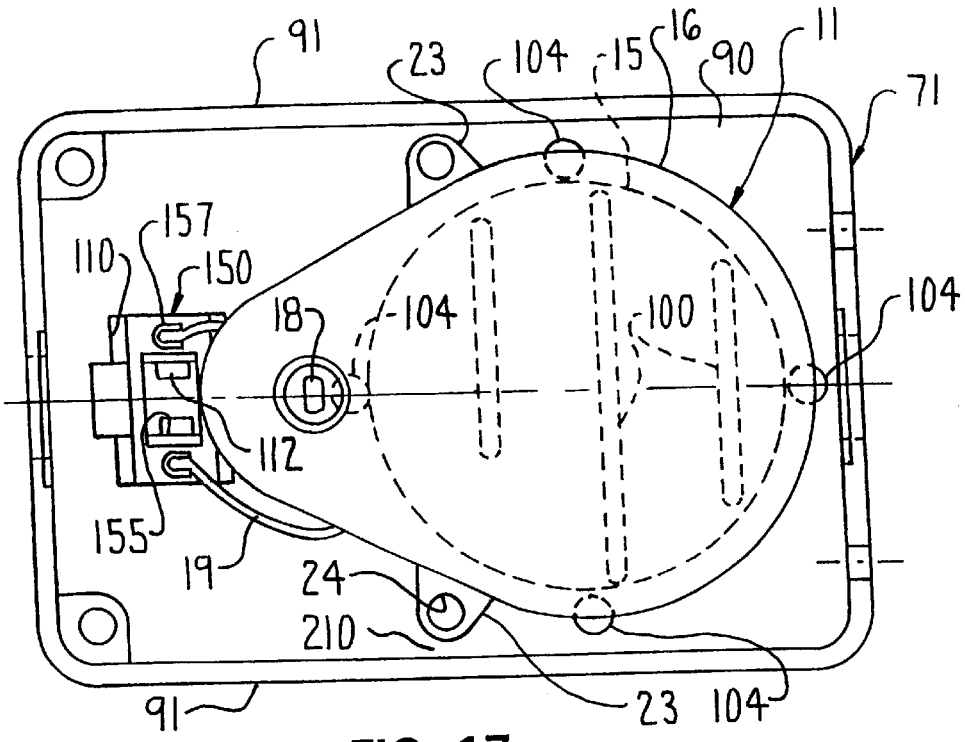
FIG. 17 is a front view of the FIG. 3 housing cup with only the motor unit and electrical connector installed.
Figure 20:
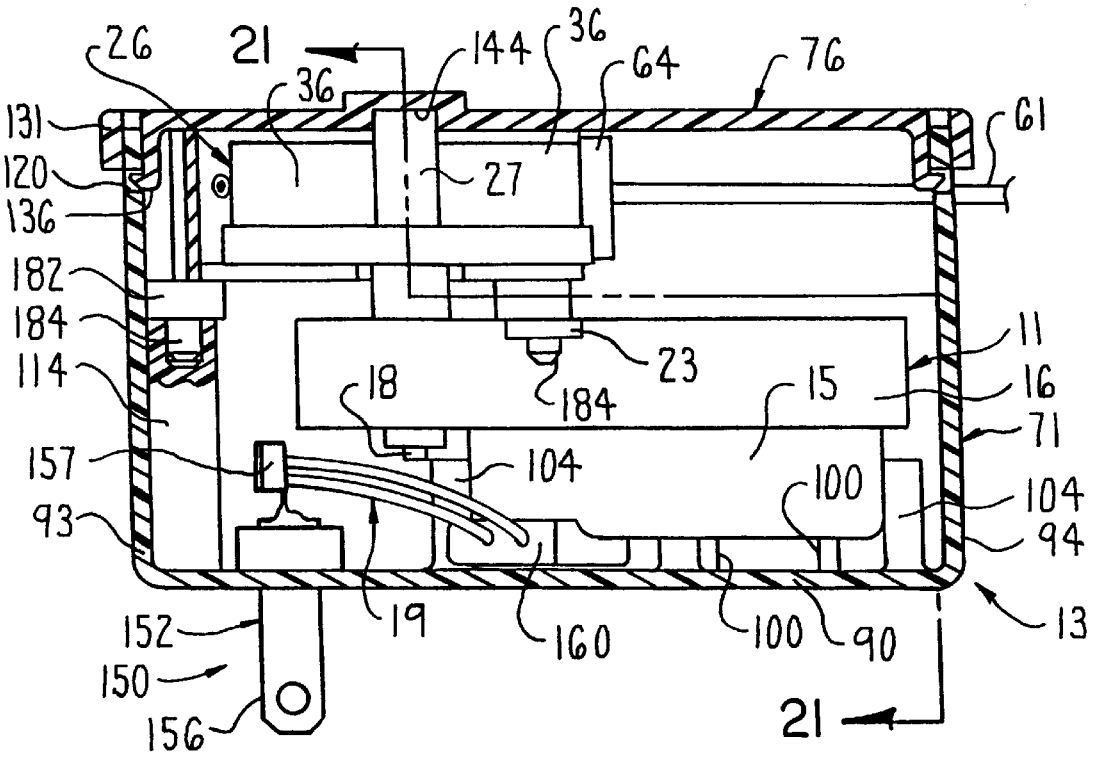
FIG. 20 is a partially broken side elevational view of the completed pump assembly of FIG. 1, corresponding in general to FIG. 3 but in an unexploded condition.
Figure 21:
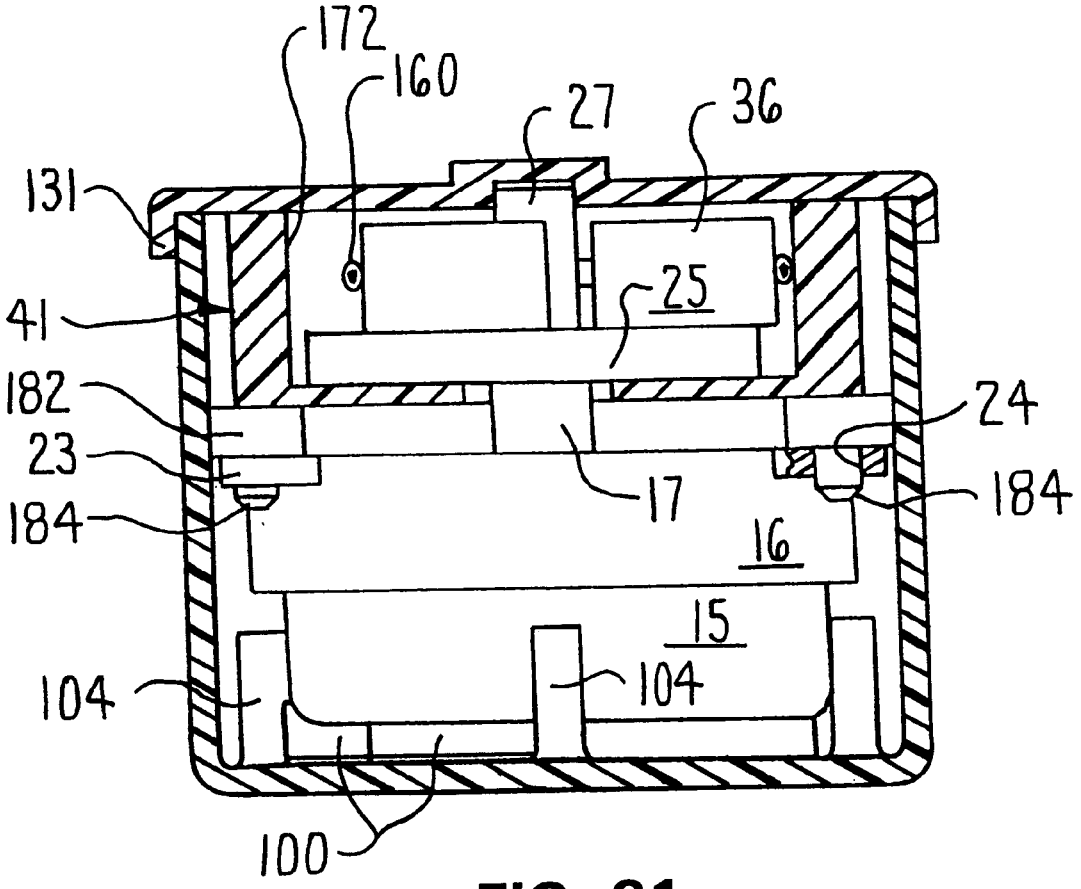
FIG. 21 is a sectional view substantially taken on line 21—21 of FIG. 20.

The remaining ends of the conductors of the electric cable 19 are then inserted into corresponding electrical receptacles of the terminal block 160 of the motor unit 11, as generally indicated in FIG. 3. The motor unit 11 is then inserted rearward (downward in FIG. 3) into the open front of the cup 71 until the back wall of the motor casing portion 15 rests against the ribs 100 and the periphery of the motor casing portion 15 is snugly surrounded by the motor locator pins 104, with the terminal block 160 at rest adjacent the cup back wall 90 and the longitudinal axis of the drive shaft substantially on the longitudinal center line of the cup back wall 90 between the electric plug-in 150 and the nearest motor locator pin 104, and close adjacent the latter, as generally indicated in FIGS. 17 and 20. In this position, the pins 104 positively prevent linear displacement of the motor unit 11 along the cup back wall 90. However, clearance (indicated at 210 in FIG. 17) between the ears 23 and adjacent cup side walls 91 allows the motor unit 11 to pivot about the central axis of its motor casing portion 15, within the bounds of the pins 104, and thus allow slight side-to-side pivoting of the drive shaft 18 (for example, to an extent approximating the diameter of the drive shaft 18) to allow the drive shaft 18 to center itself with respect to the rotor 26 and shield 41 during subsequent assembly steps discussed below. This leaves the apparatus in its partially assembled condition of FIG. 17.

To continue assembling of the pump assembly 10, the rollers 36 (FIGS. 12–16) are snap fitted on the spindles 33 atop the disc 25. So assembled, the rollers 36 are axially fixed on but freely rotatable on the spindles 33 and slightly overhang the periphery of the disc 25.

Thereafter, the central portion of the tube 60 is wrapped snugly around the array of rollers 36 of the rotor 26 (FIG. 12) and the resulting combination is inserted rearwardly into the central cavity (defined by the inner periphery 172 and back wall 170) of the shield 41, with the rear face of the rotor disc 25 resting against the front face of the shield back wall 170. To ease entry of the hose 60 and rotor 26 combination into the cavity of the shield 41, the installer resiliently pivots further apart the two halves 41A and 41B of the shield 41, on the axis of the integral hinge portion 202 (FIG. 8), for example to widen the open end of the slot 196 about to the extent indicated at 196A in FIG. 8, and thus to correspondingly enlarge the shield cavity bounded by the inner periphery 172. Thus, the rotor 26 and tube 60 combination, though diametrally wider than the relaxed shield cavity, easily slides rearwardly into the shield cavity. Thereafter, the installer releases the two halves 41A and 41B of the shield 41 and allows the resilience of the resilient hinge 202 to snugly grip the rotor 26 and tube 60 combination between the shield halves 41A and 41B.

Figure 4:
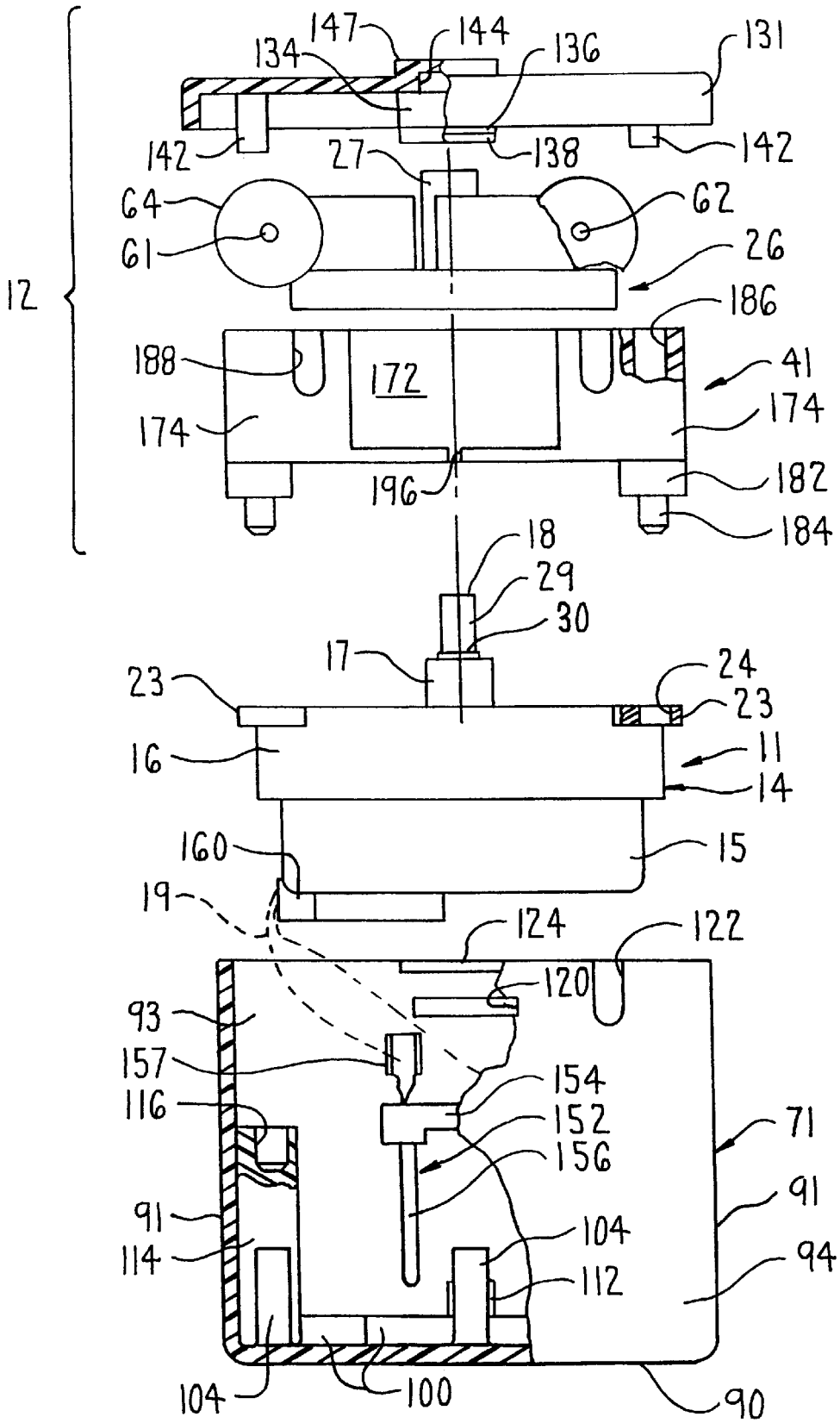
FIG. 4 is a partially broken, exploded bottom elevational view of the FIG. 1 pump assembly.

Thereafter, the tube ends 61 and 62 are lead beyond the array of rollers 36 through the notches 188 in the shield end bosses 174, as in FIGS. 19 and 20. In the preferred embodiment shown, two retainer elements 64 are provided; same are preferably identical and in the form of a washer-like disc (FIGS. 3 and 4). The washer-like retainer discs 64 are slid along their corresponding tube ends 61 and 62 into snug abutting relation with the corresponding shield end bosses 174.

Figure 18:
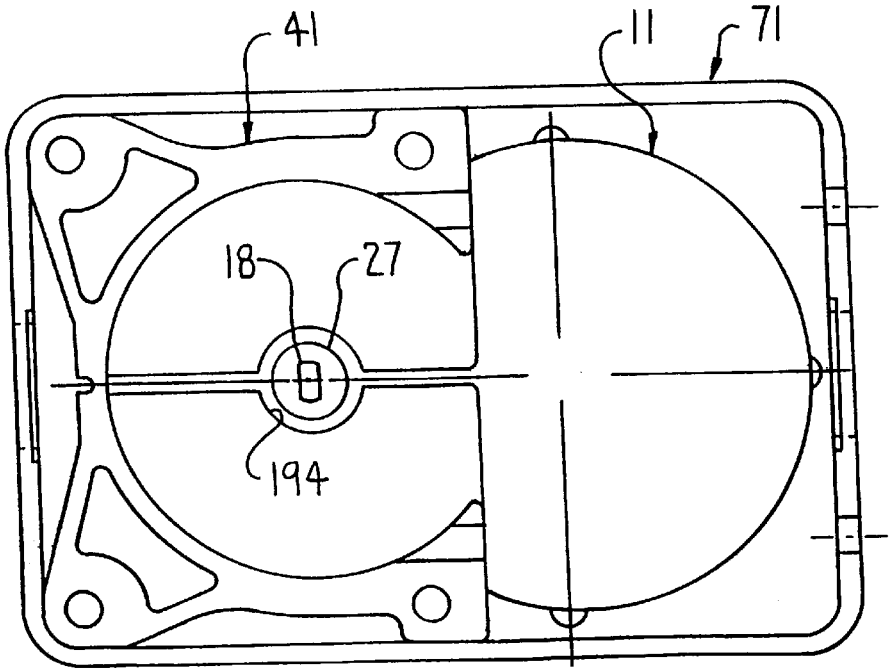
FIG. 18 is a view similar to FIG. 18 but with the pump unit shield installed.

Thereafter, the installer inserts the shield 41/rotor 26/tube 60 combination rearwardly into the open front of the cup 71, as in FIGS. 19 and 20. To ease such insertion, the installer may press the shield end bosses 174 toward each, and thereby pivot the shield halves 41A and 41B, toward each other, as permitted by the resilient hinge 202. This narrows the slot 196 toward its open end, compresses laterally the tube 60 against the rollers 36, and thus allows the end bosses 174 to slide between the side walls 91 of the cup without interference. Once the shield 41 is at least partially inserted rearward into the cup 71, the installer need no longer squeeze together the end bosses 174. As the shield 41/rotor 26/tube 60 combination slides rearward into its installed position in the cup 71, the pegs 184 of the shield 41 snugly enter the corresponding blind bores 116 in the cup corner bosses 114 and the holes 24 in the motor unit ears 23, and the flatted drive shaft end portion 29 (FIG. 3) axially snugly and drivingly enters the correspondingly flatted central opening 28 (FIG. 13) of the rotor disc 25. The installer can pivot the motor unit 11 (FIG. 17) slightly within the bounds of the pins 104, as allowed by the clearances 210, to center the ear holes 24 and drive shaft 18 coaxially of their corresponding pegs 184 and rotor central opening 28. Further, the installer can rotate rotor 26 as needed to diametrally align the flatted central opening 28 with the flatted shaft 18. Insertion of the shield 41/rotor 26/tube 60 combination into the cup 71 stops when the shield stub columns 182 abut the cup corner bosses 114 and outer unit ears 23, as seen in FIG. 20. Thereafter, the tube ends 61 and 62 (FIGS. 19 and 20) are lead through the notches 122 in the cup bottom wall 94 out of the cup 71 for connection to the fluid source F and fluid consuming device U respectively. Note: for additional clarity in disclosure, FIG. 18 shows the shield 41 installed in the cup 71, but absent the rotor 26 and tube 60.

Next, the cover 76 (FIGS. 3 and 20) is moved rearwardly onto the open front of the cup 71 with the following results. The cover peripheral lip 131 telescopes over the front edge portions of the cup side walls 91 and top and bottom end walls 93 and 94, and the cover front wall 130 abuts the front edges of the cup side walls 91 and top and bottom end walls 93 and 94. In the process, the bevels 138 of the cover feet 136 slide on the corresponding cup end wall bevels 124, the cover snap fastener legs 134 bend resiliently toward each other, the cover feet 136 slide rearward along the cup end walls 93 and 94, and the cover feet 136 snap resiliently away from each other into the cup end wall rectangular slots 120. Snug bearing of the feet 136 on the forward edge of the corresponding rectangular slots 120 fixedly but releasably fixes the cover 76 firmly against the open front of the cup 71. The cover shield locating pins 142 snugly slide rearwardly into the corresponding blind of bores 186 in the shield end bosses 174 and assist the shield pegs 184 and motor unit ears 23 in rigidly locating the shield 41 with respect to the motor unit 11 and housing 13. Further, the motor bearing recess 144 receives the front end portion of the rotor boss 27 (FIG. 20) to rotatably pilot same.

The discs 64 sufficiently frictionally grip the tube ends 61 and 62, circumferentially with the rotor 26 and longitudinal creeping of the tube 60 with respect to the shield 41, due to either clockwise (as shown) or counter-clockwise rotor rotation. In addition, the diameter of the retainer discs 64 is sufficient to abut the installed cover 76, as generally indicated in FIG. 20, to help maintain the tube 60 in the shield notches 188.

The pump 10 assembly can be disassembled by reversing the above steps. To start removal of the cover 76 from the cup 71, a screwdriver blade, or the like can be inserted into the rectangular slots 120 to displace inward, and thus unlock the feet 136 therefrom.

In operation, the tube ends 61 and 62 are connected to any desired fluid source F (FIG. 19) and fluid consuming device U, which may be located adjacent, or at a substantial distance from, the housing 13. The pump assembly 10 is then moved rearward to engage the lugs 156 both electrically and mechanically in the receiving sockets of a conventional 115 volt AC wall receptacle. The AC wall receptacle thus both supplies electrical energy to the pump assembly 10 and fixedly locates it in its operating environment.

Electric current from the source S circulates through the spade elements 152 (FIG. 20) and attached cable 19 and a conventional electric motor (not shown) housed in the motor casing portion 15 of the motor unit 11, which drives a conventional gear train (not shown) in the gear casing portion 16 to rotate the shaft 18 and rotor 26. The rotating rotor 26 orbits its rollers 36 along the length of the tube 60 within the shield 41. The rollers 36 each pinch the tube 60 against the shield inner periphery 172 (FIG. 19) and thereby constrict the tube. Each orbiting roller 36 thus advances a tube constriction along the length of the tube in a direction away from the tube inlet and toward the tube outlet 62 in the usual manner of a peristaltic pump.

The motor unit 11 may have any derived output shaft speed. For example, in one unit constructed according to the invention, the motor unit shaft 18 rotated at ½ revolution per minute (rpm). However, motor units with greater or lesser shaft speed may be substituted during manufacture or, by disassembly and reassembly of the pump assembly 10, as above indicated, when a pump assembly 10 is to be adapted to meet new operating requirements.

The pump assembly 10 is capable of various uses, but particularly excels at very low rate, metered, liquid delivery. Depending on shaft 18 speed, the rate may range up or down from a droplet or two per minute.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A self-contained, enclosed, flexible tube metering pump assembly, comprising:

a hollow, box-like housing enclosed by plural walls;

a motor unit and a pump unit fixed in said housing, said pump unit having a rotor driven by said motor unit;

a pump assembly mounting member fixed to and extending through a wall of said housing, said mounting member having an externally accessible part engageable with a conventional external power source for (1) mechanically mounting said pump assembly thereon and (2) supplying operating power thereto, said mounting member having an internal part in said housing adjacent said motor unit, an elongate member in said housing connecting said internal part to said motor unit for energizing said motor unit, said mounting member defining a power supply connector.

2. The apparatus of claim 1 in which said housing walls define a cup having an open front and a cover closing said front of said cup, said connector and motor unit and pump unit being layered in said housing between said cover and an opposed back wall of said cup, said connector extending through said cup back wall, said pump unit abutting said cover, said motor unit having a portion between said connector and pump unit.

3. The apparatus of claim 2 in which said motor unit comprises a motor casing portion backed by said housing back wall and located adjacent said connector, said motor unit further comprising an output casing portion fixed on the front of said motor casing portion and having a part cantilevered laterally therefrom and overhanging in front of said connector, said motor unit having an shaft driving said pump unit rotor, said shaft extending forward from said overhanging part toward said pump unit and away from said connector.

4. The apparatus of claim 1 in which said housing comprises an open front cup closed by a cover, said cup and cover defining said plural walls of said housing, said metering pump assembly being free of conventional separate fastening elements of the kind including threaded and permanently distortable fastening elements, said metering pump assembly consisting of said cup, cover, motor unit, power supply connector, elongate member and pump unit, said pump unit including said rotor, a tube engaged by said rotor and anti-creep retainers on said tube.

5. The apparatus of claim 1 in which said connector comprises an electrically insulative carrier having a through opening and laterally spaced electrically conductive spade elements extending through said carrier on opposite ends of said through opening, said housing back wall having a pair of holes and at least one post fixedly extending forward from said back wall in the said housing between said holes, rear portions of said spade elements extending rearwardly through said holes and defining said externally accessible part, said post extending forward through said carrier opening, said connector being fixed in said housing with said carrier adjacent said cup back wall.

6. A self-contained, enclosed, flexible tube metering pump assembly, comprising:

a housing enclosed by plural walls comprising an open front cup closed by a cover, said cup having a back wall spaced opposite said cover and a perimeter wall, said cover and back wall and perimeter wall defining said plural housing walls;

a motor unit having a casing and a forward extending shaft rotatable with respect to said casing, said casing being disposed in said housing and against said back wall;

a pump unit comprising a fixed member and a rotor rotatably located in said fixed member and operatively connected to said shaft for rotation thereby, said pump unit being disposed in said housing and located against and between said motor unit and cover, said back wall and cover thereby fixing said motor unit and pump unit therebetween.

7. The apparatus of claim 6 in which the said cup and cover have compatible snap fit connections which fix said cover snugly on said cup to effect said clamping of said motor unit and pump unit.

8. The apparatus of claim 6 in which said pump unit and motor unit are sandwiched in said housing between, and respectively backed by, said cover and cup back wall, said cover being fixed on said cup, said cover and back wall positively axially inseparably fixing said rotor on said motor unit shaft.

9. The apparatus of claim 6 in which a portion of said housing walls bound and therewith fixedly locate said pump unit and motor unit against translation in a plane transverse to a rotation axis of said shaft.

10. A self-contained, enclosed, flexible tube metering pump assembly, comprising:

a housing enclosed by plural walls comprising an open front cup closed by a cover, said cup having a back wall spaced opposite said cover and a perimeter wall, said cover and back wall and perimeter wall defining said plural housing walls;

a motor unit in said housing and backed by said back wall and having a forward extending shaft;

a pump unit in said housing and located between said motor unit and cover, said pump unit comprising a rotor, said back wall and cover clamping and thereby fixing said motor unit and pump unit therebetween, in which said motor unit is mounted with respect to said housing back wall for limited movement of said shaft in a direction parallel to said back wall and with respect to the rotation axis of said rotor, said cover having a bearing for said rotor, said motor unit shaft thus being self-centering with respect to said rotor.

11. A self-contained, enclosed, flexible tube metering pump assembly, comprising:

a housing enclosed by plural walls comprising an open front cup closed by a cover, said cup having a back wall spaced opposite said cover and a perimeter wall, said cover and back wall and perimeter wall defining said plural housing walls;

a motor unit in said housing and backed by said back wall and having a forward extending shaft;

a pump unit in said housing and located between said motor unit and cover, said pump unit comprising a rotor, said back wall and cover clamping and thereby fixing said motor unit and pump unit therebetween, in which said rotor has a boss coaxial with said shaft and extending forward toward said cover, said cover having a bearing coaxially receiving said boss in rotatable bearing relation, said cover bearing comprising a recess in the interior face of said cover.

12. The apparatus of claim 6 in which said back wall, motor unit, pump unit and cover sequentially interconnect in snugly slidable male/female connections for preventing relative lateral linear displacement therebetween.

13. A self-contained, enclosed, flexible tube metering pump assembly, comprising:

a housing enclosed by plural walls comprising an open front cup closed by a cover, said cup having a back wall spaced opposite said cover and a perimeter wall, said cover and back wall and perimeter wall defining said plural housing walls;

a motor unit in said housing and backed by said back wall and having a forward extending shaft;

a pump unit in said housing and located between said motor unit and cover, said pump unit comprising a rotor, said back wall and cover clamping and thereby fixing said motor unit and pump unit therebetween, in which said motor unit has a substantially circular motor casing portion adjacent said back wall, pins fixedly protruding forward from said back wall and circumferentially spaced snugly around said motor casing portion and permitting motor unit rotation but blocking motor unit linear displacement along said back wall, said motor casing portion and pins defining a male/female connection therebetween.

14. The apparatus of claim 12 in which said motor unit has spaced mounting holes opening forward therefrom, said cup having forward opening bores, said pump unit including a shield, said shield having rearward extending protrusions snugly axially receivable rearward in said forward opening holes and bores and thereby preventing lateral movement of said pump unit with respect to said cup and motor unit.

15. A self-contained, enclosed flexible tube metering pump assembly, comprising:

a hollow box-like housing enclosed by plural walls, said walls defining cup having an open front and a cover closing said front of said cup;

a mounting unit and pump unit in said housing, said pump unit comprising a shield, said shield having a substantially semi-circular peripheral wall including an open side portion and a back wall spanning said peripheral wall, said shield back wall being split by a slot extending from said open side portion of said shield substantially to an intermediate portion of said shield peripheral wall, said intermediate portion including a hinge adjacent an end of said slot and permitting relative hinging apart of two parts of said shield separated by said slot, said pump unit further comprising a rotor including a disc, and an array of rollers rotatable on said disc and a resiliently pinchable tube pressed against said shield peripheral wall by said rollers, said hinging apart of shield parts easing insertion rearward of said rotor and tube into said shield.

16. The apparatus of claim 15 in which said shield has circumferentially spaced external protruding bosses, said bosses laterally abutting forward extending walls of said cup, ones of said bosses at the ends of said semi-circular peripheral wall being backed by opposed ones of said forward extending cup walls to block hinging apart of said shield parts and to hold the latter firmly against said tube and rollers.

* * * * *